US006059448A

United States Patent [19]

Reeder et al.

[11] Patent Number: 6,059,448

[45] Date of Patent: May 9, 2000

[54] CONCAVE BAFFLE

[75] Inventors: Mark Franklin Reeder, Tipp City, Ohio; Christopher Joseph Ramsey, Pittsford, N.Y.

[73] Assignee: Pfaudler, Inc., Rochester, N.Y.

[21] Appl. No.: 09/145,948

[22] Filed: Sep. 2, 1998

[51] Int. Cl.[7] ..... B01F 7/16; B01F 15/00

[52] U.S. Cl. ..... 366/306; 422/228

[58] Field of Search ..... 366/302, 306, 366/307; 422/224, 226, 228, 229, 227, 231

[56] References Cited

U.S. PATENT DOCUMENTS

| | | | |
|---|---|---|---|
| 153,322 | 7/1874 | Dowell | 366/307 |
| 1,718,745 | 6/1929 | Laing | 366/306 |
| 2,136,936 | 11/1938 | Cohen | 366/302 |
| 3,265,368 | 8/1966 | Nocera | 366/306 |
| 3,334,870 | 8/1967 | Kropp et al. | 366/306 |
| 3,414,240 | 12/1968 | Jung et al. | 366/302 |
| 3,570,819 | 3/1971 | Rosinger | 366/302 |
| 4,085,003 | 4/1978 | Luthi . | |
| 4,494,878 | 1/1985 | Rainey, Jr. | 366/306 |
| 4,508,455 | 4/1985 | Lerman et al. | 366/247 |
| 4,542,686 | 9/1985 | Bansal . | |
| 4,614,439 | 9/1986 | Brunt et al. | 366/307 |
| 4,875,781 | 10/1989 | Raska | 366/307 |
| 4,984,899 | 1/1991 | Bollenrath et al. | 366/302 |
| 5,160,041 | 11/1992 | Taniguchi et al. | 366/307 |
| 5,248,485 | 9/1993 | Lilja et al. | 422/229 |
| 5,399,014 | 3/1995 | Takata et al. | 366/306 |
| 5,782,556 | 7/1998 | Chu | 366/307 |
| 5,800,058 | 9/1998 | Cook | 366/306 |

FOREIGN PATENT DOCUMENTS

| | | |
|---|---|---|
| 759114 | 8/1980 | Russian Federation . |
| 929765 | 5/1982 | Russian Federation . |
| 1101252 | 7/1984 | Russian Federation . |

*Primary Examiner*—Charles E. Cooley
*Attorney, Agent, or Firm*—Michael L. Dunn

[57] ABSTRACT

A baffle for insertion into a container. The baffle includes a concave surface defined by two essentially parallel line segments connected to each other at their ends by line segments subtending an angle. The baffle further includes structure for mounting to a container so that the line segments are essentially parallel to and offset from a side wall of the container. Preferably, structure for mounting is structure for suspending the baffle from a first end wall of said container without attachment to a container side wall. The concave surface is preferably a curvilinear concave surface and the contiguous line segments subtending an angle are in the form of an arc. The baffle is preferably glass coated and sized to pass through an opening in an end wall of the container.

31 Claims, 3 Drawing Sheets

CONCAVE BAFFLE

BACKGROUND OF THE INVENTION

This invention relates to baffles for use in containers used for mixing of fluids, especially where at least one of the fluids is a liquid.

The use of rotating mixers in containers, especially cylindrical tanks, in the absence of some sort of baffle, results in a swirling motion of liquid within the container. Such swirling motion is generally laminar in nature, possessing none of the turbulent flow characteristics required for mixing low-viscosity fluids. The swirling motion also possesses very little vertical movement of the fluid which is necessary for effective mixing.

It is known that baffles, placed within the container, so as to disrupt the swirling motion, creates a turbulence which greatly improves mixing efficiency. Such baffles are usually elongated flat plates placed so that their longitudinal axis is parallel to the tank wall and so that the width of the plate rests on a tank diameter. The baffle is usually slightly offset from the tank wall to prevent accumulation of material at a baffle-tank wall interface.

It has been generally believed that four, rectangular, side-wall mounted baffles are the most effective baffle system available. Such baffles are not, however, suitable for use in vessels which are lined with a corrosion resistant material, such as glass plastic or some chemically resistant alloys, since they cannot be easily attached to the tank sidewall for support without creating a breach in the corrosion resistant lining. Further, the configuration of such rectangular baffles are not generally suited for lining with a corrosion resistant layer because of severe angles associated with a four sided plate.

It has been known to suspend corrosion resistant, e.g. glass lined, baffles, either from the top or bottom of a tank. Such baffles must thus be sized to fit through an access hole in the tank. Known baffles, including fin type baffles and rectangular baffles are not as efficient as desired for that purpose. Further rectangular baffles are not suitable for suspension, since the width of the baffle is restricted by the size of the access hole. Further for suspension of four rectangular baffles proximate four sidewalls, four access holes would be needed.

BRIEF DESCRIPTION OF THE INVENTION

Figure 1:
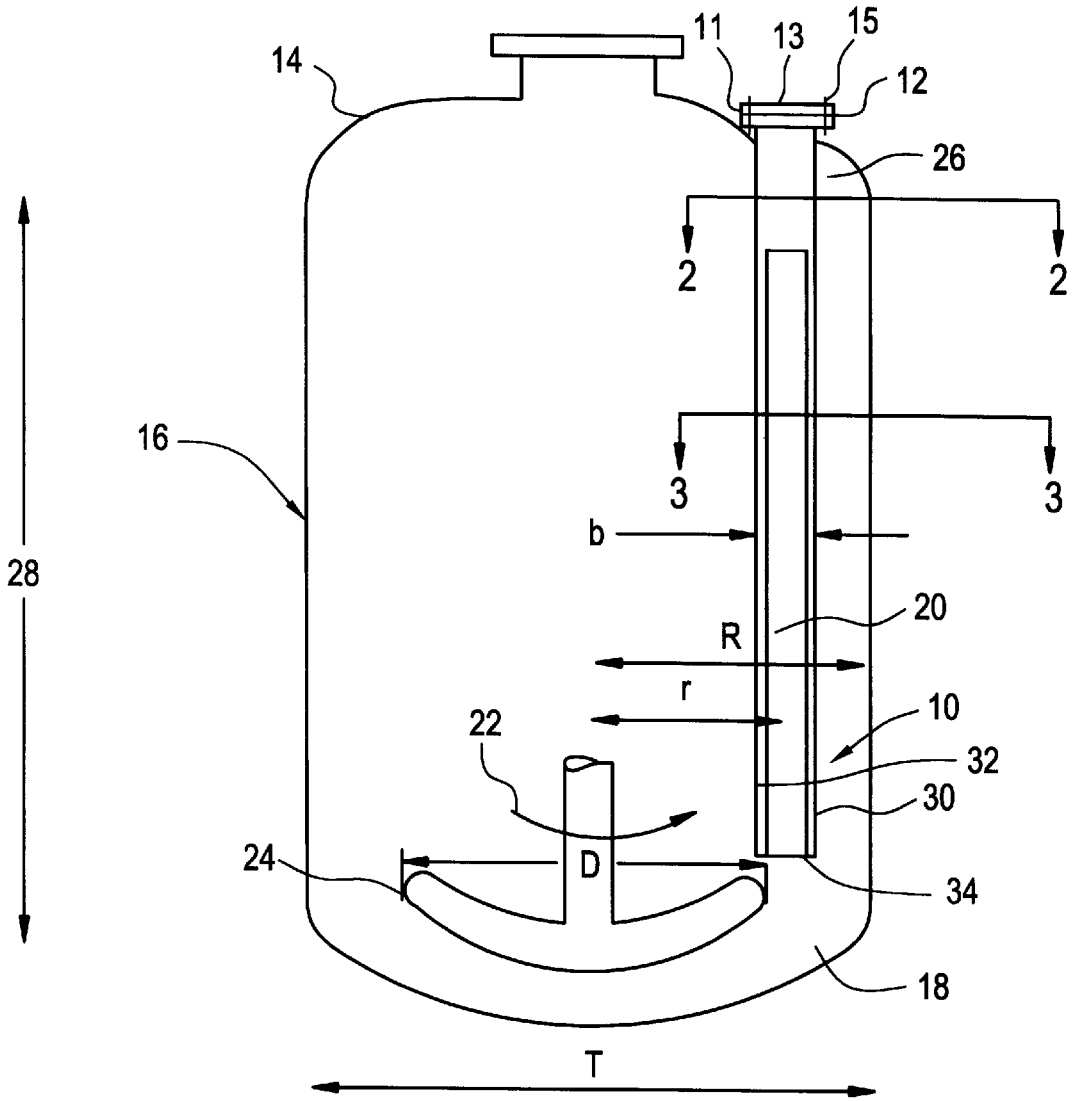
FIG. 1 is a schematic cross sectional view of a tank containing a preferred embodiment of a baffle of the invention.
Figure 2:
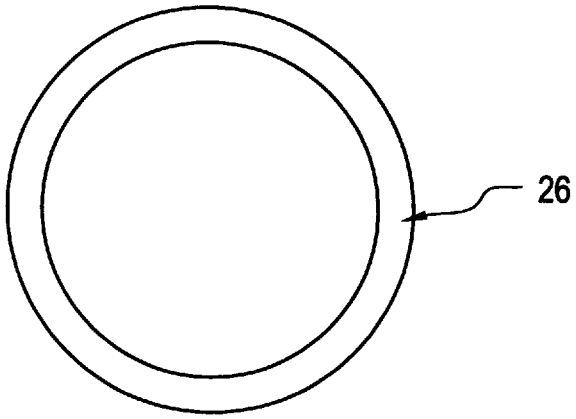
FIG. 2 is a cross section of an upper supporting portion of the baffle in FIG.1 taken at line 2—2.

In accordance with the invention, there is provided a new baffle design which is more efficient than previous baffles for apparent surface area contact, and especially more efficient than those which could be inserted through an access opening in an end wall of a container. Further the new baffle is easy to manufacture and can be easily made in a configuration suitable for coating with a corrosion resistant material, especially glass.

More particularly the invention comprises a baffle for insertion into a container. The baffle comprises a concave surface defined by two essentially parallel line segments connected to each other at their ends by line segments subtending an angle. The baffle further includes a means for mounting to a container so that the line segments are essentially parallel to and offset from a side wall of the container.

Preferably, the means for mounting is a means for suspending said baffle from a first end wall of said container without attachment to a container side wall. The concave surface is preferably a curvilinear concave surface and the contiguous line segments subtending an angle are in the form of an arc.

In a preferred embodiment, chords joining ends of each arc are less than one-fourth of a length of a diameter of the container and more preferably from about 9 to about 13 percent of the diameter of the container.

The baffle is desirably sized to pass through as opening in a first endwall of the container, which opening is less than one-fourth of the diameter of the container.

DETAILED DESCRIPTION OF THE INVENTION

"Baffle" as used herein means a surface used to disrupt liquid flow in a container provided with a rotating agitation means. Such a baffle has a length (sides) and a width (ends) defining the surface and is usually mounted in a container so that the length is oriented in the same direction as a length of the container.

"Container" means essentially any container which can hold liquid and a rotating agitation means. The container may be defined by a single sidewall, as when the sidewall is circular in shape to form a cylinder or may be defined by a plurality of sidewalls to form a polygonal cross section. The containers usually have either a circular cross section with a single curved sidewall or rectangular cross section with four adjoining sidewalls. Such containers are usually tanks having a circular cross section. The main body of the tank is usually cylindrical.

"Concave surface" means a surface having a depressed central portion. In general the concave surface is defined by two essentially parallel line segments connected to each other at their ends by contiguous line segments subtending an angle. The parallel lines and line segments define the surface of the baffle. The parallel lines are oriented along the length of the baffle. Curved lines, connecting the parallel line segments, may be considered as an infinite number of contiguous line segments. Such concave surfaces may be in many forms, e.g. a surface formed by two plates intersecting at an angle or surface formed by a plate in the form of a semiellipse, parabola or hyperbola. The "apparent surface area" of the baffle is an area defined by the length of the baffle times the length of a chord joining ends of the parallel line segments. The chord may also be referred to as the "projected width".

The means for mounting in accordance with the invention may be supports mounted to the baffle along its length and to a sidewall of the container, but in accordance with the invention is usually a support mounted at an end of the baffle for suspending the baffle from an end wall of the container without mounting to a sidewall of the container. Such an end support may, for example, be an attachment by bolts or welding to a cover which attaches to a flange surrounding an access hole in the top wall of a container. In such a case the access hole is usually less than one-fourth of the diameter of the container and the baffle is sized to pass through it.

Preferably, the baffle of the invention is coated with a corrosion resistant material. Such materials may be plastics, ceramics, glass and corrosion resistant metal alloys. The preferred corrosion resistant coating is glass. "Glass" as used herein means any contiguous inorganic surface formed by fusion of water insoluble inorganic materials. Such glasses are usually amorphous and are formed by fusion of glass frit. Examples of such glasses are various silicate glasses. In order to permit "glassing", the baffle of the invention usually has rounded corners and edges. Such a baffle having curved edges is readily formed by pressing a tube or pipe, having opposed convexly curved sides, in a die to cause one side (one-half) of the tube or pipe to conform essentially to the curve of the other half of the tube or pipe to form a concave surface. In such a case, the baffle takes the form of a double curvilinear surface attached at the location of the parallel line segments.

The concave baffles of the invention may be considered to be a specific form of insertable baffles suitable for use in glass-lined mixing vessels. Such inserted baffles, in a preferred arrangement, is located at a radius (r) which is 72–82% of the full vessel radius (R), with a projected width (b) which is 9–13% of the vessel diameter (T), and an overall length which allows it to range over the vessel straightside length 28 as shown in FIG. 1. Optionally more than one such insert baffle may be used.

As shown in FIG. 1, a baffle 10 in accordance with the invention defined by parallel line segments 30, 32 and contiguous line segments 34 subtending an angle (FIGS. 3–6), may be supported from a nozzle opening 12 in either the top head 14 or bottom head 18 of a mixing vessel 16. Such a top head support is shown in FIG. 1 wherein the baffle 10 is attached about a circumference 11 of the opening 12 by means of attachment to a flange 13 which is bolted around the circumference by means of bolts 15 and which closes the opening. The baffle also may be mounted from an opening in a sidewall of the vessel; although, such a configuration is not typical. The baffle is oriented so that concave portion 20 of baffle 10 faces the direction of flow 22 produced by a rotating impeller 24 such as typically used in a mixing vessel. In this orientation, concave baffle 10 of the invention thoroughly interrupts ineffective swirling flow and converts it into an effective three dimensional turbulent flow.

Figure 3:
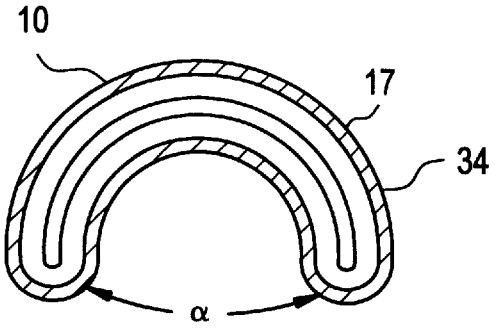
FIG. 3 is a cross section of the baffle in FIG. 1 taken at line 3—3 showing a baffle formed by pressing a pipe into a concave cross section comprising double curvilinear surfaces.
Figure 4:
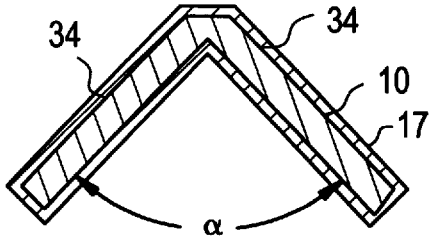
FIG. 4 is an alternative embodiment of a cross section of a baffle of the invention showing a concave cross section formed by plates attached at an angle "$\alpha$".
Figure 5:
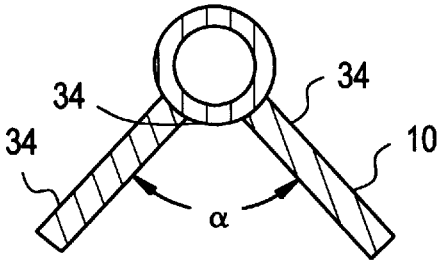
FIG. 5 is an alternative embodiment of a cross section of a baffle of the invention formed by plates at an angle $\alpha$ attached to a hollow pipe.
Figure 6:
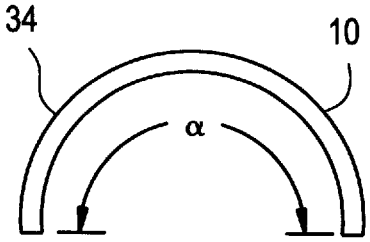
FIG. 6 is an alternative embodiment of a cross section of a baffle of the invention formed by a plate pressed into an arcuate cross section.

In the preferred embodiment of the invention shown in FIG. 1, baffle 10 supported from nozzle 12 of top 14 of vessel 16 has a semicircular cross section and corrosion resistant coating as shown in FIG. 3. This cross section is preferably a semicircle with a total arc of about 180 degrees. This profile has a desirably high drag coefficient of about 2.3. This is significantly higher than the drag coefficients for known cross sections used for inserted baffles and is higher than flat baffles when they are used in the same numbers as inserted baffles. The top end 26 of baffle 10 may have a circular cross section for ease of support. The baffle may have other concave cross sections, e.g. as shown in FIGS. 4, 5 and 6. The other concave cross sections in accordance with the invention also have high drag coefficients.

The concave baffle of the invention offers significant improvement in baffle effectiveness over other inserted baffle designs because it can interrupt swirling flow induced by an impeller to a greater degree with the same number of baffle elements and the same projected width.

Figure 7:
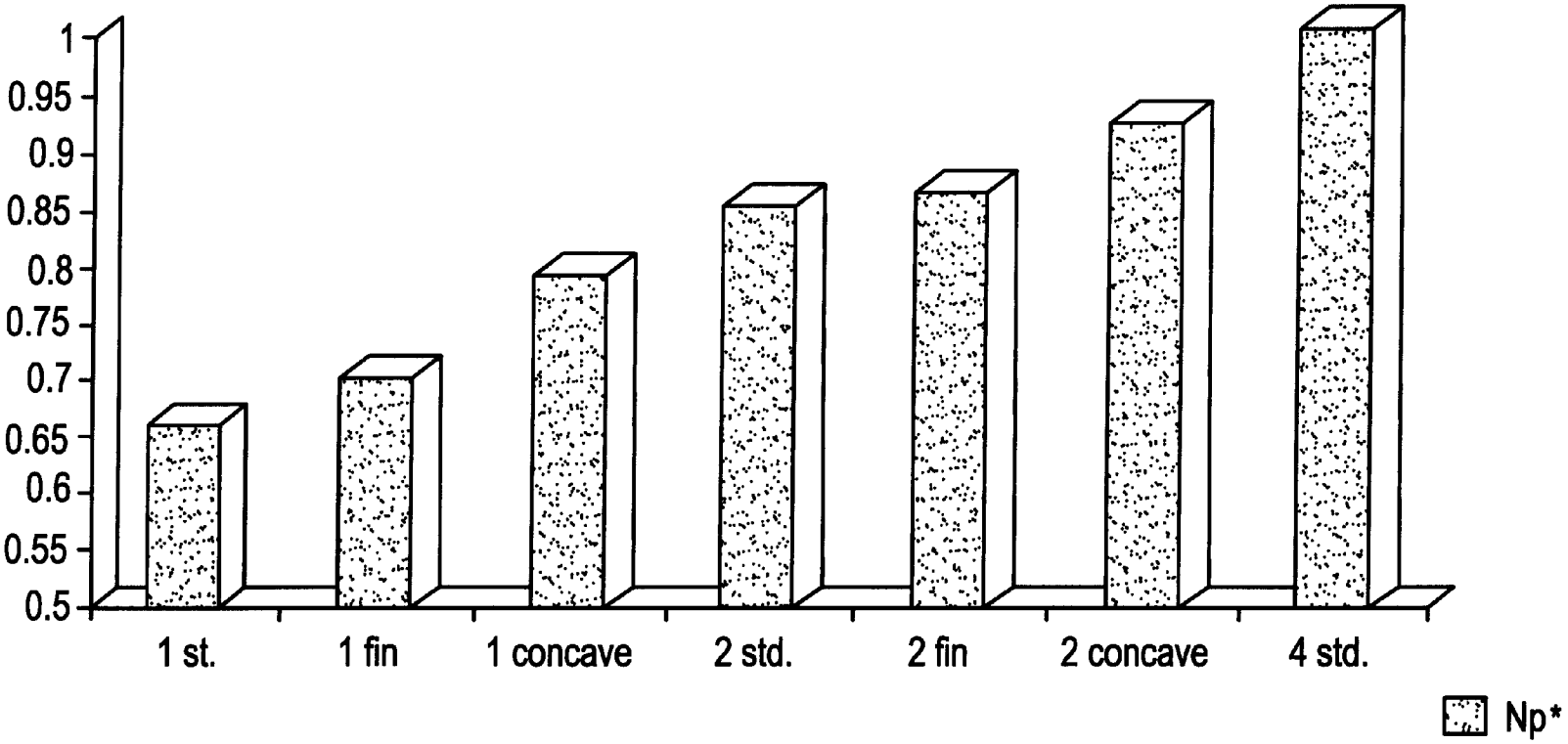
FIG. 7 is a bar graph showing the effect of baffles of various configurations upon normalized power number.

Baffle effectiveness is indicated by the characteristic power number of an impeller system used in conjunction with a given baffle system. For a given impeller type with a span (D) operating at a speed (N) in a full vessel, the power number of the impeller will be a function of Reynolds number (i.e. flow regime) and baffle type. When four sidewall baffles are used, a vessel is assumed to be fully baffled with a maximum power number. When fewer than four inserted baffles are used (the usual case), the power number at a given Reynolds number is reduced. The more effective the baffle, the less the reduction in the power number. A comparison of baffle effectiveness is shown in FIG. 7 where one and two concave baffles of the invention are compared with full baffling (4 standard baffles), one and two standard (i.e., wall-mounted) baffles, and one and two fin baffles which were considered the most effective insert type baffle until the present invention. In FIG. 7, CBT means "Curved Blade Turbine" (an impeller commonly used in glass-lined mixing vessels); Re>100,000 defines the range of Reynolds number (Re) for the data shown, and indicates the flow to be fully turbulent; and Np means "Normalized Power Number", with all values referenced to the Power Number for a fully baffled (4 standard baffles) case.

FIG. 7 clearly shows that the concave baffles of the present invention are more efficient than an equal number of standard wall-mounted or traditional fin type baffles and are almost as effective as four standard flat baffles when only two concave baffles are used.

What is claimed is:

1. A baffle for insertion into a container, said baffle comprising a concave surface defined by two essentially parallel line segments connected to each other at their ends by from two to an infinite number of contiguous line segments subtending an angle, said baffle further comprising means for mounting said baffle so that said essentially parallel line segments are essentially parallel to and offset from a side wall of the container wherein said means for mounting is a means for suspending said baffle from a first end wall of said container without attachment to a container side wall so that its concave surface faces a direction of flow produced by a rotating impeller within the container, said baffle being coated with a corrosion resistant material.

2. The baffle of claim 1, wherein said concave surface is a curvilinear concave surface, and said connecting contiguous line segments subtending an angle are an infinite number of line segments in the form of an arc.

3. The baffle of claim 2, wherein chords joining ends of each arc less than one-fourth of a length of a diameter of the container.

4. The baffle of claim 3 wherein said baffle is sized to pass through an opening in said first endwall which is less than one-fourth of the diameter of the container.

5. The baffle of claim 4, wherein said baffle is glass coated.

6. The baffle of claim 5, wherein the baffle has rounded corners and edges.

7. The baffle of claim 3, wherein said baffle is glass coated.

8. The baffle of claim 7, wherein the baffle has rounded corners and edges.

9. The baffle of claim 2 wherein said baffle is sized to pass through an opening in said first endwall which is less than one-fourth of the diameter of the container.

10. The baffle of claim 9, wherein said baffle is glass coated.

11. The baffle of claim 10, wherein the baffle has rounded corners and edges.

12. The baffle of claim 9, wherein said baffle is attached about a circumference of said opening by means of attachment to a flange which is bolted around said circumference and which closes said opening.

13. The baffle of claim 2, wherein said means for suspension is a means for vertical suspending from the first end wall which is a top of the container.

14. The baffle of claim 13, wherein said baffle is glass coated.

15. The baffle of claim 14, wherein the baffle has rounded corners and edges.

16. The baffle of claim 2, wherein said baffle is coated with a corrosion resistant material.

17. The baffle of claim 16, wherein said baffle is glass coated.

18. The baffle of claim 17, wherein the baffle has rounded corners and edges.

19. The baffle of claim 2, wherein said baffle is glass coated.

20. The baffle of claim 19, wherein the baffle has rounded corners and edges.

21. The baffle of claim 2, wherein said baffle comprises double curvilinear surfaces attached at the location of said parallel line segments.

22. The baffle of claim 21, wherein said baffle has rounded corners and edges.

23. The baffle of claim 22, wherein said baffle is glass coated.

24. The baffle of claim 21, wherein said baffle is glass coated.

25. The baffle of claim 21, wherein said baffle is formed from a metal tube having opposed outwardly convexly curved sides, one of said convexly curved sides being pressed to invert the convex curve to a concave curve in conformance with the shape of the remaining opposed convexly curved side.

26. The baffle of claim 25, wherein said baffle is glass coated.

27. The baffle of claim 1, wherein said baffle is coated with a corrosion resistant material.

28. The baffle of claim 27, wherein said baffle is glass coated.

29. The baffle of claim 28, wherein the baffle has rounded corners and edges.

30. The baffle of claim 1, wherein said baffle is glass coated.

31. The baffle of claim 30, wherein the baffle has rounded corners and edges.

* * * * *